US007173204B2

(12) United States Patent
Schmidt et al.

(10) Patent No.: US 7,173,204 B2
(45) Date of Patent: Feb. 6, 2007

(54) CONTROL PANEL ASSEMBLY WITH MOVEABLE ILLUMINATING BUTTON AND METHOD OF MAKING THE SAME

(75) Inventors: Robert M. Schmidt, Livonia, MI (US); Leonard E. Pagano, Warren, MI (US); James B. Wright, Sterling Heights, MI (US)

(73) Assignee: Lear Corporation, Southfield, MI (US)

( * ) Notice: Subject to any disclaimer, the term of this patent is extended or adjusted under 35 U.S.C. 154(b) by 216 days.

(21) Appl. No.: 10/846,067

(22) Filed: May 14, 2004

(65) Prior Publication Data

US 2005/0252758 A1 Nov. 17, 2005

(51) Int. Cl.
*H01H 9/00* (2006.01)

(52) U.S. Cl. ..... 200/310; 200/314; 362/84

(58) Field of Classification Search ..... 200/310–314, 200/317; 362/84–85, 23–25
See application file for complete search history.

(56) References Cited

U.S. PATENT DOCUMENTS 4,730,146 A * 3/1988 Maser et al. ..... 313/511
5,073,843 A 12/1991 Magee ..... 362/84
5,315,491 A 5/1994 Spencer et al. ..... 362/84
5,536,543 A 7/1996 Papandreou ..... 428/35.7
5,739,486 A 4/1998 Buckingham ..... 200/5
5,757,756 A 5/1998 Hajjar ..... 369/275.1
5,818,174 A * 10/1998 Ohara et al. ..... 315/169.3
5,899,553 A 5/1999 Howell ..... 362/84
6,040,534 A * 3/2000 Beukema ..... 200/5 A
6,148,075 A 11/2000 Inubushi et al. ..... 379/368
6,168,283 B1 1/2001 Howell ..... 362/84
6,373,008 B1 * 4/2002 Saito et al. ..... 200/310
6,698,085 B2 * 3/2004 Stevenson et al. ..... 29/622

* cited by examiner

*Primary Examiner*—Kyung Lee
(74) *Attorney, Agent, or Firm*—Bill Panagos

(57) ABSTRACT

A control panel assembly including at least one moveable button defining an outer surface. The control panel assembly also includes an electroluminescent film operatively supported on the outer surface of the button such that the electroluminescent film is adapted for selectively emitting light from the outer surface of the button. A method for making the control panel assembly is also disclosed.

6 Claims, 4 Drawing Sheets

CONTROL PANEL ASSEMBLY WITH MOVEABLE ILLUMINATING BUTTON AND METHOD OF MAKING THE SAME

BACKGROUND OF THE INVENTION

1. Field of the Invention

The present invention relates, generally, to a control panel assembly, and more particularly to a control panel assembly with a moveable illuminating button and a method of making the same.

2. Description of the Related Art

Many devices include control panels with stylized displays, dials, knobs and more. Control panel assemblies can also include buttons as a means for controlling associated systems. For instance, vehicle control panel assemblies can include buttons used to control the vehicle air conditioner, stereo, and more. When light levels are low, however, the user may not be able to properly see the control buttons.

Partially in response to this need, control panel assemblies have been designed which include light sources for backlighting the buttons. Incandescent light bulbs, LEDs, and the like are supported near the back surface of the buttons to backlight the buttons and allow the user to see the controls. However, the light sources of these control panel assemblies typically generate undesirable heat when illuminated, can be sensitive to shock, and generally disperse light unevenly. Also, these control panel assemblies often require light pipes to direct light in a desired path, thereby increasing assembly time and cost. Furthermore, these light sources and the light pipes take up a relatively large amount of space. Therefore, there is an ongoing need for an improved means for illuminating control panel assemblies.

Some control panel assemblies include buttons that are backlit with electroluminescent (EL) film. EL film is a known material having a phosphorous layer that emits light when a voltage is applied. For instance, U.S. Pat. No. 6,148,075 to Inubushi et al. discloses such a control panel assembly for a cellular telephone. The control panel assembly includes a button array and an EL film for backlighting the buttons. The EL film is disposed behind the button array such that light emitted from the EL film backlights the button array.

Although the Inubushi et al. control panel assembly generally works for its intended purpose, some disadvantages remain. For instance, in some applications, especially in vehicle control panel assemblies, buttons with a relatively long stroke are preferred. However, the buttons of the Inubushi et al. device are connected together, and this arrangement can limit the amount of travel of the button. Moreover, because the EL film is disposed behind the buttons, light emitted from the EL film may not be strong enough to be adequately seen through the buttons.

Therefore, there remains an ongoing need for an improved control panel assembly with buttons that includes EL film for illuminating the controls. Specifically, there is a need for such a control panel assembly with improved manufacturability and improved display characteristics.

SUMMARY OF THE INVENTION

The disadvantages of the related art are overcome by the control panel assembly of the present invention, which includes at least one moveable button defining an outer surface. The control panel assembly also includes an electroluminescent film operatively supported on the outer surface of the button such that the electroluminescent film is adapted for selectively emitting light from the outer surface of the button.

In another aspect, the present invention is directed toward a method of forming a control panel assembly that includes the step of inserting an electroluminescent film into a mold cavity. The method also includes the step of injecting a molten material into the mold cavity and curing the material to form a frame member and at least one button. The button is supported by the frame member such that the button is moveable relative to the frame member, wherein the electroluminescent film is bonded on an outer surface of the button.

One advantage of the present invention is that the control panel assembly enhances the visibility of the button for the user. In addition, the electroluminescent film provides even lighting, is less sensitive to shock, consumes relatively little power, and generates very little heat when lit. Furthermore, the control panel assembly is relatively compact and requires few parts.

Additionally, the method of the present invention can be employed to make a control panel assembly in a relatively short amount of time. Also, the control panel assembly can be formed in complex 3-D shapes with any number of graphics and textures for increased aesthetic appeal.

Other features and advantages of the present invention will be readily appreciated, as the same becomes better understood, after reading the subsequent description taken in conjunction with the accompanying drawings.

DETAILED DESCRIPTION OF THE PREFERRED EMBODIMENT(S)

Figure 1:
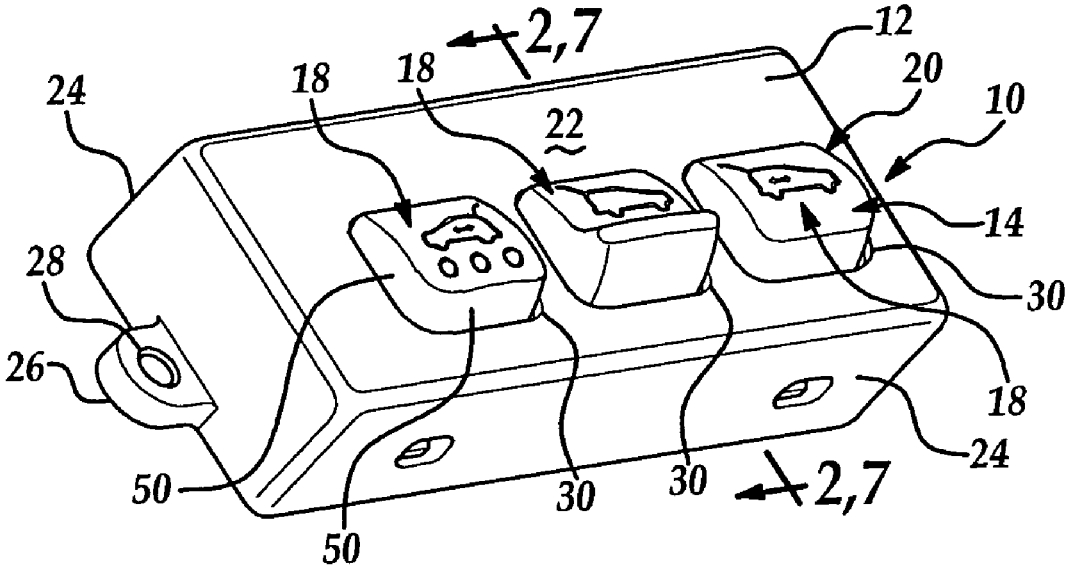
FIG. 1 is a perspective view of one embodiment of a control panel assembly of the present invention.
Figure 2:
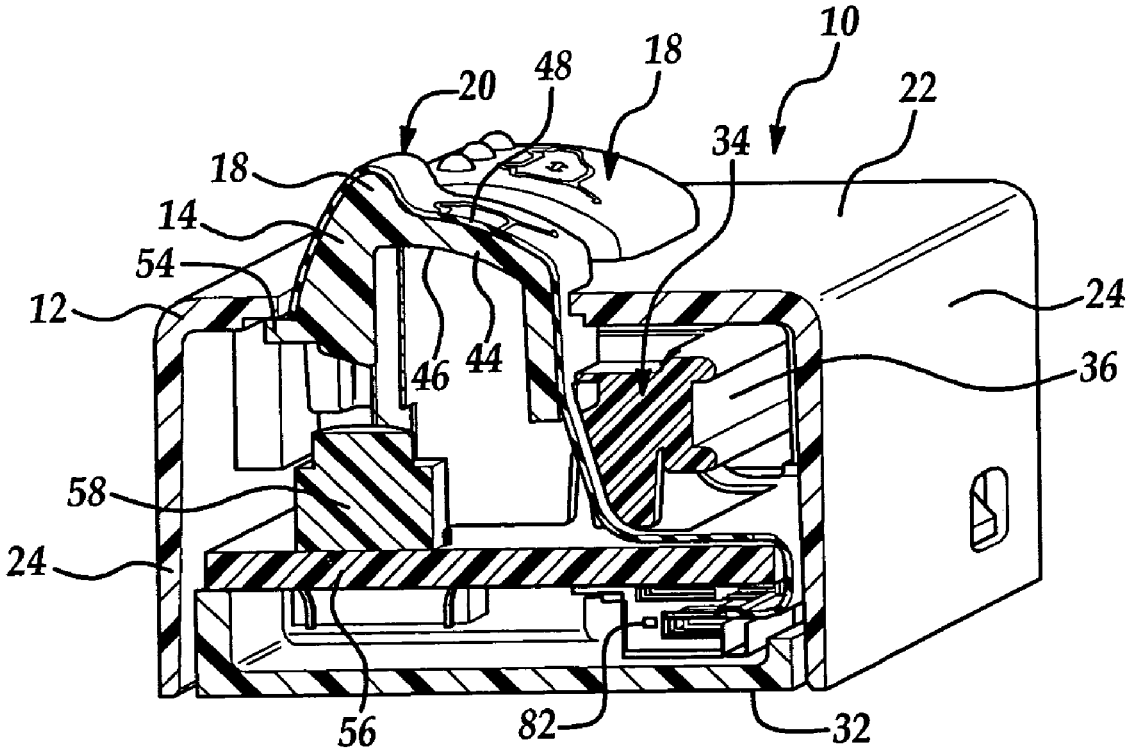
FIG. 2 is a sectional view of the control panel assembly taken along the line 2—2 of FIG. 1.
Figure 3:
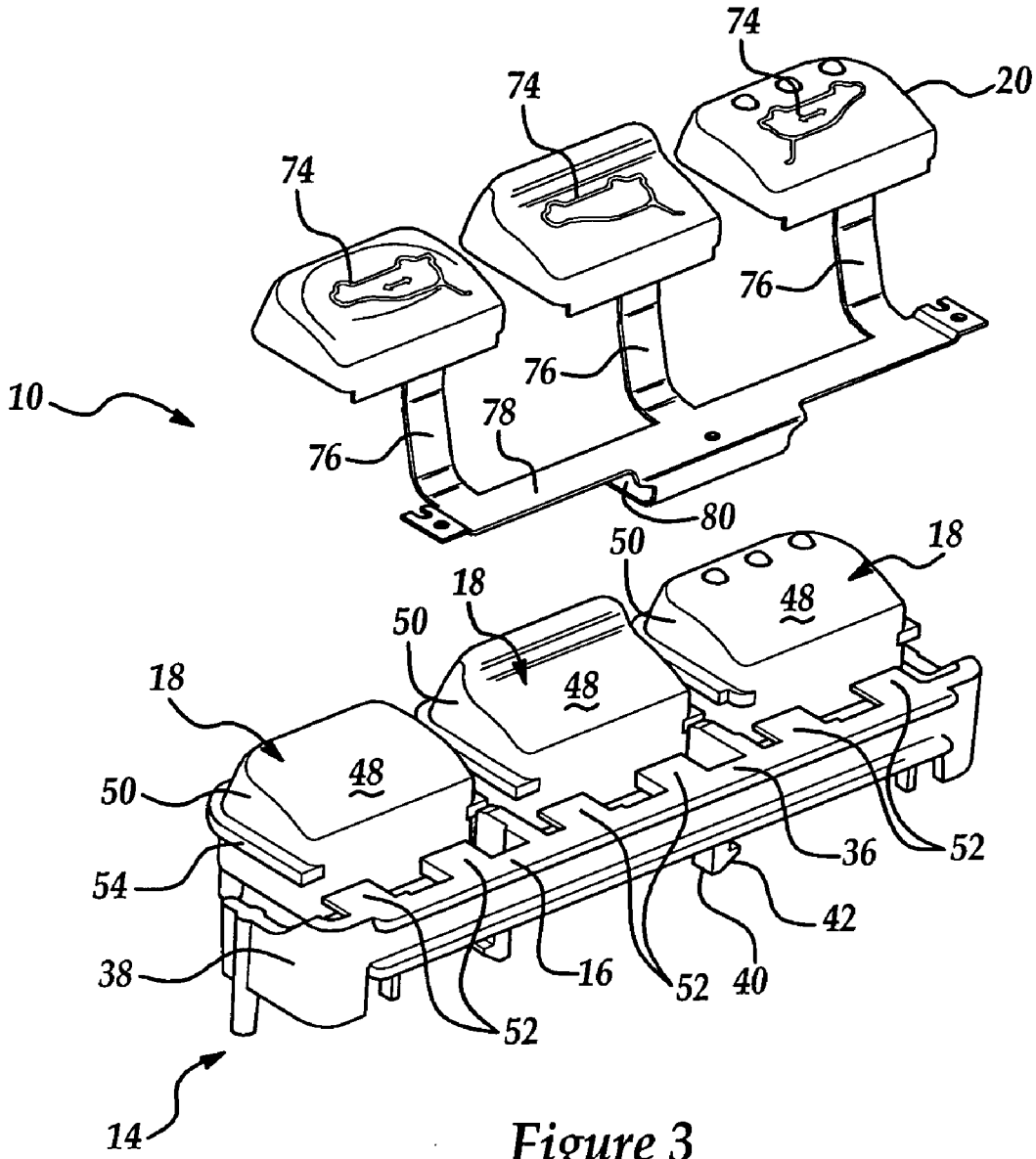
FIG. 3 is an exploded view of the control panel assembly.

Referring now to the drawings, where like numerals are used to designate like structure throughout the figures, one embodiment of a control panel assembly of the present invention is generally illustrated at 10 in FIGS. 1–3. The control panel assembly 10 generally includes a support structure 12 and a button assembly 14 supported by the support structure 12. The button assembly 14 includes a frame member 16, at least one moveable button 18 supported by the frame member 16, and an electroluminescent (EL) film 20 disposed relative to the button 18 on an other surface of the button 18 as will be discussed in greater detail below. As will be described in greater detail, the control panel assembly 10 emits highly visible light such that the user can more easily control associated systems, and the control panel assembly 10 can be manufactured more efficiently than other comparable existing control panel assemblies.

As shown in FIGS. 1 and 2, the support structure 12 is box-like so as to define a top face 22 and a plurality of sides 24. The support structure 12 includes flanges 26 extending from opposing sides 24, and an aperture 28 extends through each flange 26. The support structure 12 also includes a plurality of openings 30 extending through its top face 22. In the embodiment illustrated in FIG. 1, there are three openings 30. Additionally, the support structure 12 includes a substantially flat bottom plate 32 attached to the sides 24 to define an inner space 34 inside the support structure 12. In general, the support structure 12 allows mechanical attachment of the control panel assembly 10 via the apertures 28 to other components, such as a dashboard of a vehicle (not shown) or a housing of a remote control unit (not shown). The support structure 12 also operatively supports the button assembly 14 and EL film 20 as described below. It should be understood that the support structure 12 shown in FIGS. 1 and 2 does not limit the present invention, and the support structure 12 could take on any one of a variety of shapes without departing from the spirit of the invention.

As shown in FIGS. 2 and 3, the frame member 16 of the button assembly 14 includes an elongate rail 36 and end posts 38 integrally attached at each end of the rail 36. The rail 36 moveably supports the buttons 18 as will be described in greater detail below. The frame member 16 also includes a plurality of resilient clips 40 attached at one end to the rail 36 and having a triangular head 42 extending away from the other end. As will be described in greater detail below, the clips 40 allow mechanical attachment of electronics components for the control panel assembly 10. The frame member 16 generally provides mechanical attachment of various components within the support structure 12 as will be described in greater detail below.

In the embodiment shown, the control panel assembly 10 includes three buttons 18. Each button 18 includes a generally rectangular contact face 44 that defines an inner surface 46 and an outer surface 48. Each button 18 also includes four sides 50 that extend downwardly from the edges of the contact face 44. A rail 54 partially extends around the periphery of each button 18 extending outwardly from three of the four sides 50. Furthermore, as shown in FIG. 3, two flat hinge members 52 are spaced apart and extend from one of the sides 50 of each button 18, and the hinge members 52 are integrally attached to the rail 36. Each button 18 is hingeably supported by the frame member 16 via the hinge members 52 such that each button 18 is moveable relative to the frame member 16. The button assembly 14 is disposed within the support structure 12 such that the frame member 16 is supported within the inner space 34 of the support structure 12 and the contact face 44 of each button 18 extends through the corresponding openings 30 of the support structure 12.

The control panel assembly 10 also includes a circuit board 56, which includes a plurality of circuit traces and other components that form one or more electric circuits. A switch 58, such as a tact switch or an elastomer with a pill, is attached to the circuit board 56. When actuated, the switch 58 generates an input signal that is sent through a corresponding circuit of the circuit board 56. The circuit board 56 is disposed within the inner space 34 of the support structure 12, such that the switch 58 is positioned underneath the button assembly 14. In one embodiment, the circuit board 56 includes apertures (not shown) that are spaced according to the spacing of the resilient clips 40, and the heads 42 of the resilient clips 40 secure the circuit board 56 to the button assembly 14. The control panel assembly 10 also includes a biasing member (not shown), such as a leaf spring, underneath each button 18 so as to bias the respective button 18 outward from the support structure 12 and to support the respective button toward and away from the circuit board 56. The rail 54 of each button 18 abuts against the support structure 12 to thereby limit the outward movement of the respective button 18. Also, when a user presses one of the buttons 18 against the force of the biasing member, the button 18 actuates the switch 58, thereby generating the corresponding input signal to be sent through the electric circuit of the circuit board 56. It is noted that the function performed when the buttons 18 are pressed can be any of a variety of functions without departing from the spirit of the invention. For instance, pressing the button 18 could turn an air conditioner on or off, could cause a mirror to adjust, could lock or unlock a vehicle door, or the like.

As shown in FIGS. 1–3, the outer surface 48 of the buttons 18 can include any one of a variety of features that help the user differentiate between buttons 18 and/or enhance the tactile feel of the button 18. For instance as shown in FIGS. 1–3, the outer surface 18 of the buttons 18 can include contours, raised edges, and/or raised points for these purposes.

Figure 4:
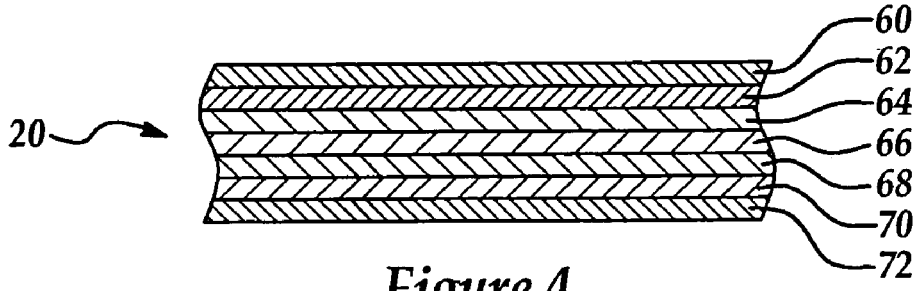
FIG. 4 is a sectional view schematically illustrating an electroluminescent film suitable for use in the control panel assembly.

As stated above, the control panel assembly 10 also includes an EL film 20. The EL film 20 includes a plurality of layers shown schematically in FIG. 4. More specifically, the EL film 20 includes a film layer 60. In one embodiment, the EL film 20 is formed by screen printing, and the film layer 60 acts as a printing substrate for the other layers described below. The film layer 60 can also act as a protective coating layer for the EL film 20 to thereby increase the operating life of the EL film 20. The EL film 20 also includes a front electrode layer 64 and a back electrode layer 70, each made from any suitable conductive material, such as conductive ink. The EL film 20 further includes a decorative layer 62 disposed between the film layer 60 and the front electrode layer 64. The decorative layer 62 is composed of inks deposited to form any desired design. The decorative layer 62 can include opaque ink and translucent ink to form the desired design. For instance in the embodiment shown in FIGS. 1–3, translucent ink of the decorative layer 62 forms the shape of a vehicle with an open rear hatch or trunk lid to thereby indicate the function performed when the button 18 is pressed.

Furthermore, the EL film 20 includes a phosphorous layer 66 disposed between the front electrode layer 64 and the back electrode layer 70. As will be discussed in greater detail below, the EL film 20 of the control panel assembly 10 is adapted for selectively emitting light due to the phosphorous layer 66. In addition, the EL film 20 includes a dielectric layer 68 disposed between the phosphorous layer 66 and the back electrode layer 70. The dielectric layer 68 can be formed of any material suitable for forming a dielectric barrier.

The EL film 20 also includes a conductor layer 72. The conductor layer 72 can be made out of any suitable conductive material, such as silver. In one embodiment, the conductive layer 72 is included only on predetermined portions of the EL film 20 to form circuits, which electrically connect the EL film 20 to corresponding circuits on the circuit board 56. Also, in one embodiment, a predetermined portion of the conductor layer 72 electrically communicates with the back electrode layer 70 and another predetermined portion of the conductor layer 72 extends through open sections of the back electrode layer 70, dielectric layer 68, and phosphorous layer 66 so as to electrically communicate with the front electrode layer 64. As such, a voltage may be applied across the front and back electrode layers 64, 70, thereby causing the phosphorous layer 66 to energize and emit light.

As shown in FIG. 3, the EL film 20 includes a plurality of separate graphics areas 74 with a lead 76 extending from each of the graphics areas 74. Each graphics area 74 is shaped according to the shape of a corresponding button 18, and the leads 76 each extend from a side of the graphics area 74. The graphic symbols and the phosphor layer 66 are included in the graphics areas 74 for emitting light therefrom. The leads 76 supply the necessary voltage to illuminate the phosphor layer 66 in the graphics area 74. In the embodiment shown, the leads 76 are joined into a common lead 78. The common lead 78 includes a terminal end 80 that is used to electrically connect the EL film 20 to the circuit board 56 in any one of a variety of ways discussed below. It should be appreciated that each lead 76 can contain any number of individual conductive paths. Also, it should be appreciated that the common lead 78 can contain any number of conductive paths. For instance, in one embodiment, the common lead 78 contains a single conductive path, and this conductive path is split in three so as to extend through each of the leads 76. In another embodiment, each lead 76 contains an individual conductive path, and each one extends through the common lead 78 insulated from the other two.

It should be appreciated that the film layer 60 and/or decorative layer 58 can be any number of textures and/or colors to thereby enhance the appearance of the control panel assembly 10. For instance, the film layer 60 and/or decorative layer 58 can have the appearance of brushed aluminum, wood grain, and more.

Figure 5:
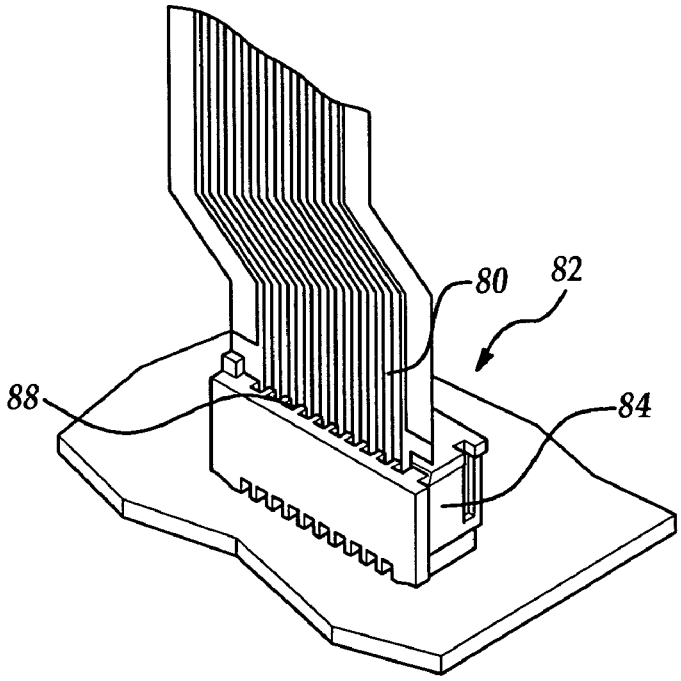
FIG. 5 is a perspective view of one embodiment of a connector suitable for use in the control panel assembly.
Figure 6:
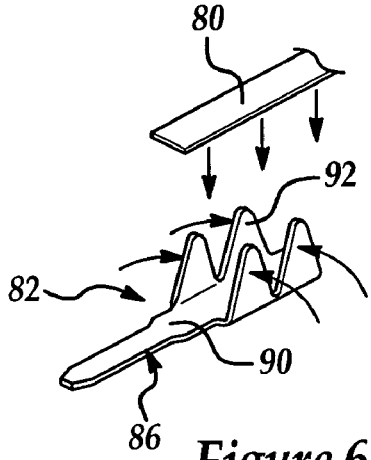
FIG. 6 is a perspective view of another embodiment of a connector suitable for use in the control panel assembly.

As shown in FIG. 2, the control panel assembly 10 also includes an electrical connector, generally indicated at 82. The electrical connector 82 is adapted for electrically connecting the terminal end 80 of the EL film 20 to the corresponding circuit of the circuit board 56. As shown in FIGS. 5 and 6, the electrical connector 82 can be one of many known types, and can be chosen from a group consisting of a zero-input force (ZIF) connector 84 (FIG. 5) and a crimp connector 86 (FIG. 6). The ZIF connector 84 includes a connector slot 88 on one side and is electrically and mechanically connected to the circuit board 56. The terminal end 80 of the EL film 20 is inserted into connector slot 88 to create an electrical connection between the EL film 20 and the circuit board 56. Alternatively, the crimp connector 86 shown in FIG. 6 can be used to establish this electrical connection. The crimp connector 86 includes a flat base 90 with a plurality of prongs 92 extending outward therefrom. To make an electrical connection, the terminal end 80 is moved toward the base 90 such that the prongs 92 pierce the terminal end 80 and the conductive layer 72 therein. The prongs 92 are bent to further secure the terminal end 80, and the crimp connector 86 can be attached to the circuit board 56 by any suitable method, such as soldering, to complete the electrical connections.

As noted above and as shown in FIGS. 1–3, the EL film 20 is operatively supported on the outer surface 48 of the button 18. More specifically, the graphics areas 74 are fixedly attached to the outer surfaces 48 of the corresponding buttons 18, and the leads 76 freely extend therefrom such that the buttons 18 can be pressed individually without actuating the other buttons 18. In the embodiment shown, the lead 76 of each button 18 is positioned between the respective pair of hinge members 52 of the button 18.

The circuitry included in the circuit board 56 and the EL film 20 allows the EL film 20 to emit light in any one of a variety of scenarios. For instance, if the control panel assembly 10 is included in a vehicle (not shown), the EL film 20 can emit light whenever the engine is running or whenever the ambient light in the vehicle is low such that the buttons 18 are more visible to the user. In another embodiment, the EL film 20 emits light when the corresponding button 18 is pressed, and the EL film 20 stops emitting light when the button 18 is pressed again. This latter example can be employed in association with a button 18 that controls a "power on" and "power off" feature such that the lit condition of the EL film 20 would indicate that the power is on, and the unlit condition of the EL film 20 would indicate that the power is off. The circuitry in the circuit board 56 and the EL film 20 can allow each graphics area 74 to illuminate individually. Thus, by emitting light from the outer surface 48 of the button 18 in these ways, the EL film 20 helps the user control the associated system and makes the buttons 18 more visible for the user, especially considering that the EL film 20 is on the outer surface 48 of the button 18 where the user presses the button 18.

Figure 7:
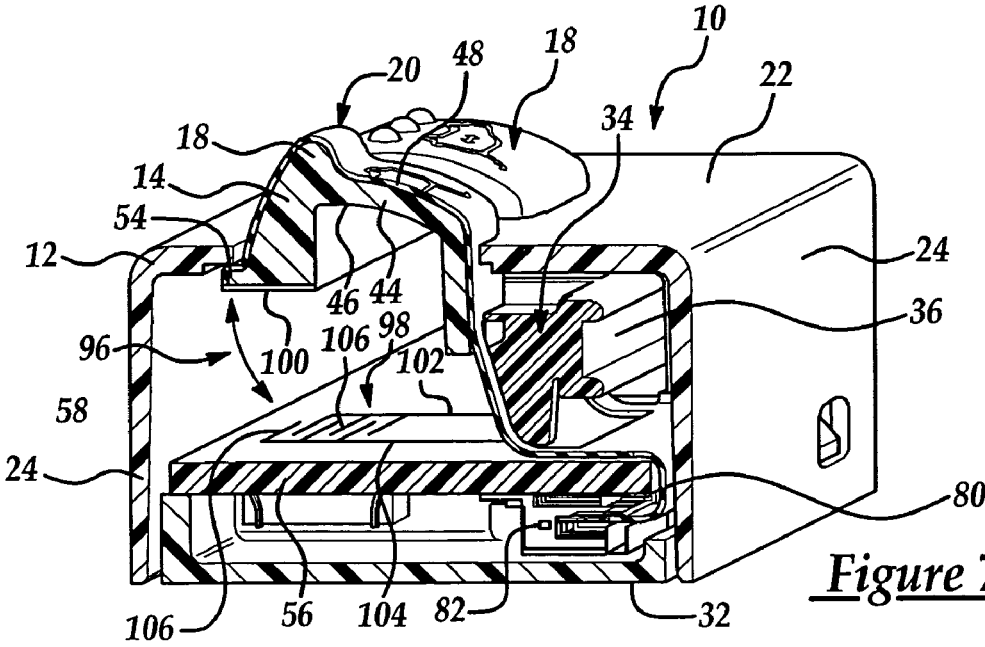
FIG. 7 is a sectional view of an alternative embodiment of the control panel assembly taken along line 7—7 of FIG. 1.

As an alternative to the switch 58 illustrated in FIG. 2, the control panel assembly 10 may employ a switching circuit, generally indicated at 96 in FIG. 7. More specifically, the circuit board 56 includes a first portion 98 of the switching circuit 96, and the EL film 20 includes a second portion 100 of the switching circuit 96. In the embodiment shown, the first portion 98 is defined by a first trace 102 and a second trace 104 printed on the circuit board 56 below the inner surface 46 of the respective button 18. Each trace 102, 104 includes a plurality of terminal ends 106. The terminal ends 106 of the first trace 102 point toward, but do not electrically communicate with, the terminal ends 106 of the second trace 104. The second portion 100 of the switching circuit 96 is a pad of conductive material, such as conductive ink, included on a portion of the EL film 20, and this portion of EL film 20 is bonded to the inner surface 46 of the button 18. In one embodiment, the second portion 100 is formed through screen printing processes.

A biasing member (not shown) is also included in the control panel assembly 10 of FIG. 7 to bias the respective button 18 away from the circuit board 56. As such, the switching circuit 96 is open when the button is positioned away from the circuit board and current does not flow through the switching circuit 96. However, when the button 18 is pressed, it hingeably moves downward toward the circuit board 56, and the second portion 100 contacts the first portion 98. When contact is made, the terminal ends 106 of the first trace 102 electrically communicate with the terminal ends 106 of the second trace 104, and current flows through the switching circuit 96. Preferably, when current flows through the switching circuit 96, an input signal is generated which ultimately causes a corresponding function to be performed, such as locking a vehicle door, adjusting a mirror, or the like. As such, the switching circuit 96 further reduces the number of parts needed for the control panel assembly 10 because tact switches and the like are not needed for generating the input signals.

In another embodiment of the switching circuit 96 (not shown), the first portion 98 is a trace printed on the circuit board 56, and the second portion 100 is a trace extending through the EL film 20 so as to electrically communicate with the electrical connector 82. Similar to the embodiment shown in FIG. 7, the button 18 is normally biased away from the circuit board 56, thereby opening the switching circuit 96, but when the button 18 is pressed, the second portion 100 contacts the first portion 98, thereby closing the switching circuit and generating the corresponding input signal. Like the embodiment shown in FIG. 7, this embodiment of the switching circuit 96 reduces the number of parts needed for the control panel assembly 10.

In still another embodiment of the switching circuit 96 (not shown), the first portion 98 is included on the circuit board 56 as shown in FIG. 7. Also, a leaf spring or other similar biasing member (not shown) is positioned underneath the button 18 and biases the button 18 outward. When a button is pressed, the biasing member flexes downward, and a conductive surface of the biasing member contacts the first portion 96 on the circuit board 56, thereby closing the switching circuit and generating the corresponding input signal.

Figure 8:
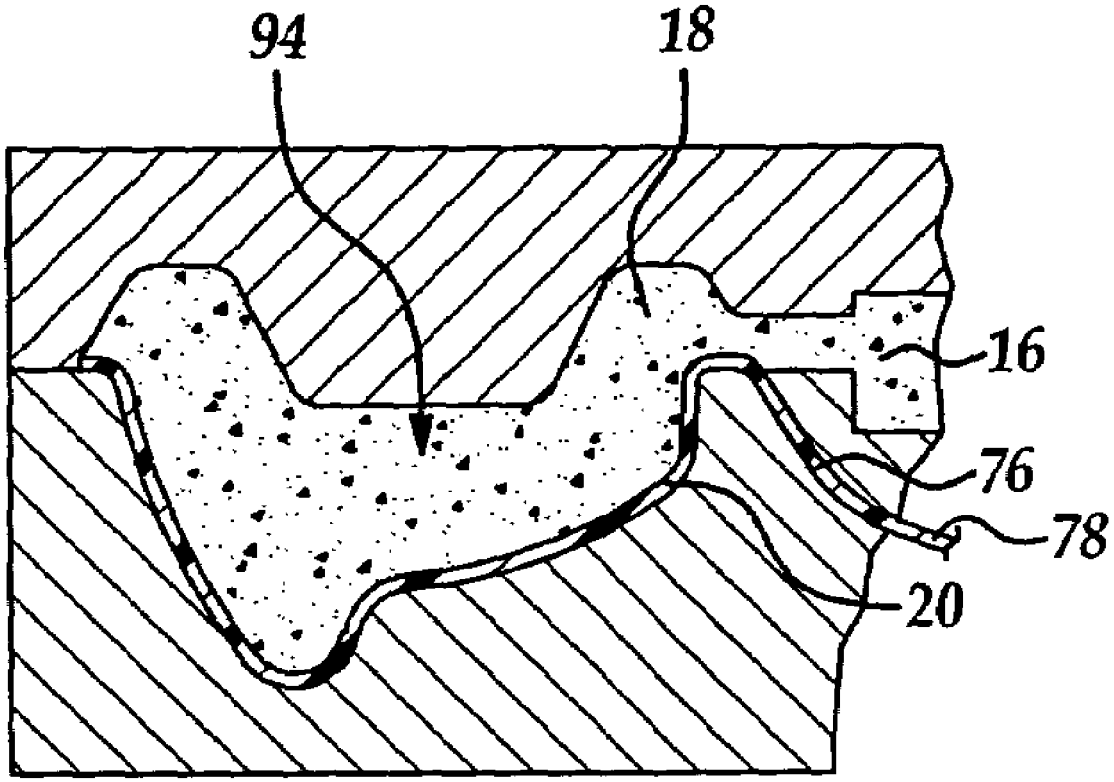
FIG. 8 is a schematic illustration of a molding process used in forming the control panel assembly.

In one embodiment, the EL film 20 is molded to the corresponding button 18. More specifically, as schematically shown in FIG. 8, the frame member 16, the buttons 18, and the EL film 20 are molded and formed into a single component with an in-mold decorating process. The in-mold decorating process is also known as insert molding. The EL film 20 can be formed by known screen printing processes to form a roll of flat EL film 20. Next, the EL film 20 is cut to form the graphics areas 74, leads 76 and common lead 78 and then thermoformed to match the profile of the button 18. Then, as shown in FIG. 8, the method involves inserting the thermoformed EL film 20 into a mold cavity 94 with the leads 76 and common lead 78 positioned away from the mold cavity 94. The method continues by injecting a molten plastic material into the mold cavity 94 and curing the material to form the button assembly 14 with the graphics areas 74 of the EL film 20 bonded to the outer surface 48 of the buttons 18 and the leads 76 and common lead 78 freely extending therefrom. Once cured, the button assembly 14 is attached to the support structure 12 and the common lead 78 is electrically connected to the circuit board 56. This manufacturing process is relatively quick and requires relatively little assembly after the molding steps. Also, there are relatively few individual parts, thereby facilitating assembly further. As such, the control panel assembly 10 can be manufactured in a more efficient manner.

In summary, the control panel assembly 10 enhances the visibility of the button for the user. In addition, the EL film 20 provides even lighting, is less sensitive to shock, consumes relatively little power, and generates very little heat when lit. Furthermore, the control panel assembly 10 is relatively compact and requires few parts.

Additionally, the control panel assembly 10 can be made in a relatively short amount of time. Also, the control panel assembly 10 can be formed in complex 3-D shapes with any number of graphics and textures for increased aesthetic appeal.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A control panel assembly comprising:

at least one moveable button defining an outer surface;

an electroluminescent film operatively supported on said outer surface of said button such that said electroluminescent film is adapted for selectively emitting light from said outer surface of said button;

a frame member hingeably supporting said button such that said button is moveable relative to said frame member;

a support structure operatively supporting said frame member, said button including a rail that abuts against said support structure to limit movement of said button; and a circuit board adapted to form at least one electrical circuit, wherein said circuit is open when said button is positioned away from said circuit board and said rail abuts against said support structure and closed when said button operatively electrically contacts said circuit board as a result of moving said button toward said circuit board.

2. A control panel assembly as set forth in claim 1, further comprising a pair of hinge members extending from a side of the button and integrally attached to said frame member, said electroluminescent film including a lead that is positioned between said pair of hinge members.

3. A control panel assembly as set forth in claim 1, further comprising an electrical connector adapted for supplying power to said electroluminescent film, said electrical connector chosen from a group consisting of a ZIF connector and a crimp connector.

4. A control panel assembly as set forth in claim 1, wherein said electroluminescent film includes a plurality of separate graphics areas with a lead extending from each of said graphics areas, and said leads are joined into a common lead.

5. A control panel assembly as set forth in claim 1, wherein said electroluminescent film includes a film layer, a decorative layer, a front electrode layer, a phosphorous layer, a dielectric layer, a back electrode layer, and a conductor layer.

6. A control panel assembly as set forth in claim 1, wherein said circuit board includes a first portion of said circuit and said electroluminescent film includes a second portion of said circuit such that said circuit is open when said button is positioned away from said circuit board and closed when said second portion contacts said first portion as a result of moving said button toward said circuit board.

* * * * *